US009303495B2

(12) United States Patent
Watson et al.

(10) Patent No.: US 9,303,495 B2
(45) **Date of Patent: *Apr. 5, 2016**

(54) DOWNHOLE TOOL FOR GUIDING A CUTTING TOOL

(71) Applicant: Thru Tubing Solutions, Inc., Oklahoma City, OK (US)

(72) Inventors: Brock Watson, Oklahoma City, OK (US); Roger Schultz, Newcastle, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/752,304

(22) Filed: Jun. 26, 2015

(65) Prior Publication Data

US 2016/0017698 A1 Jan. 21, 2016

Related U.S. Application Data

(60) Provisional application No. 62/025,295, filed on Jul. 16, 2014.

(51) Int. Cl.
*E21B 43/114* (2006.01)
*E21B 29/00* (2006.01)

(52) U.S. Cl.
CPC ..... *E21B 43/114* (2013.01); *E21B 29/00* (2013.01)

(58) Field of Classification Search
CPC ..... E21B 29/00; E21B 29/005; E21B 29/06; E21B 43/114
See application file for complete search history.

(56) References Cited

U.S. PATENT DOCUMENTS

| | | | | |
|---|---|---|---|---|
| 4,346,761 | A * | 8/1982 | Skinner | E21B 23/006 166/206 |
| 5,484,016 | A * | 1/1996 | Surjaatmadja | E21B 4/006 166/104 |
| 6,286,599 | B1 * | 9/2001 | Surjaatmadja | E21B 29/06 166/240 |
| 7,195,067 | B2 * | 3/2007 | Manke | E21B 43/114 166/298 |
| 8,316,943 | B2 | 11/2012 | Fagley, IV et al. | |
| 8,657,007 | B1 * | 2/2014 | Watson | E21B 19/22 166/178 |
| 2002/0029889 | A1 | 3/2002 | George et al. | |
| 2009/0044939 | A1 | 2/2009 | Booth | |
| 2010/0122817 | A1 | 5/2010 | Surjaatmadja et al. | |
| 2013/0133949 | A1 | 5/2013 | Xu et al. | |

OTHER PUBLICATIONS

International Search Report and Written Opinion; PCT/US2015-038092; mailed Sep. 21, 2015; 14 pages.

* cited by examiner

*Primary Examiner* — Robert E Fuller
(74) *Attorney, Agent, or Firm* — Hall Estill Law Firm

(57) ABSTRACT

An apparatus that includes a guiding tool for transferring fluid pressure to movement of a cutting tool relative to the guiding tool while the cutting tool is cutting slots in a casing or formation via at least one nozzle disposed in the cutting tool. Furthermore, a method of cutting a slot in a casing or formation using the apparatus.

17 Claims, 14 Drawing Sheets

DOWNHOLE TOOL FOR GUIDING A CUTTING TOOL

CROSS-REFERENCE TO RELATED APPLICATIONS

The present application is a conversion of U.S. Provisional Application having U.S. Ser. No. 62/025,295, filed Jul. 16, 2014, which claims the benefit under 35 U.S.C. 119(e), the disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a downhole tool used to guide a cutting tool to create slots in a casing and/or a formation downhole.

2. Description of the Related Art

Traditionally, abrasive cutting tools use a high velocity stream of abrasive fluid to cut holes in a formation or casing outside of the cutting tool. It can sometimes take ten (10) or more minutes to successfully cut a hole in the formation or casing. It may be desirable to cut slots in the formation or casing.

Accordingly, there is a need for a way to be able to cut slots in the casing or formation by moving the cutting tool at a slow enough speed to be able to continuously cut the slot in the formation or casing.

SUMMARY OF THE DISCLOSURE

This disclosure is directed toward an apparatus that includes a guiding tool for transferring fluid pressure to movement of a cutting tool relative to the guiding tool while the cutting tool is cutting slots in a casing or formation via at least one nozzle disposed in the cutting tool.

This disclosure is also directed toward a method of cutting a slot in a casing or formation using the apparatus disclosed herein.

DETAILED DESCRIPTION OF THE DISCLOSURE

Figure 1:
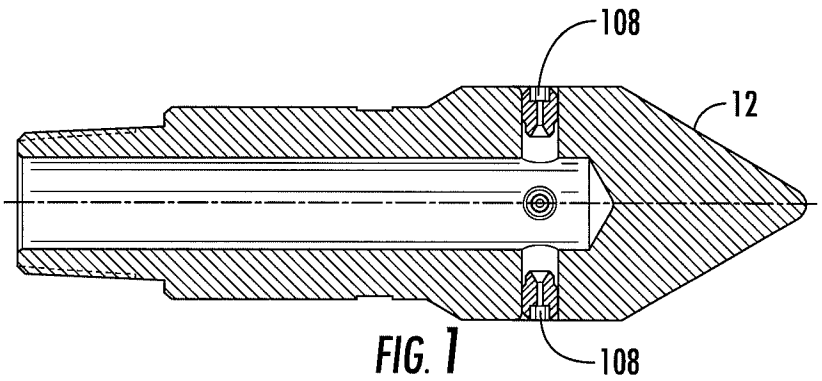
FIG. 1 is a cross-sectional view of a typical jet cutter used with a downhole tool constructed in accordance with the present disclosure.
Figure 2:
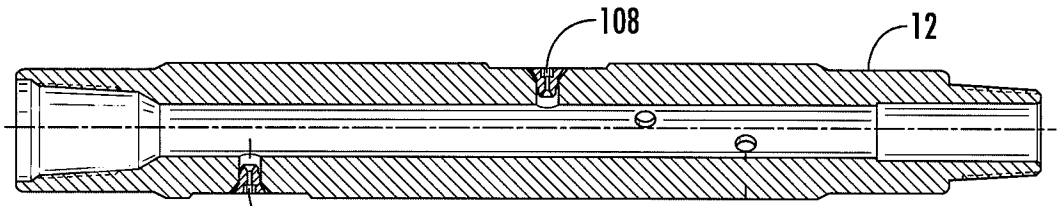
FIG. 2 is a cross-sectional view of a typical abrasive perforator used with the downhole tool constructed in accordance with the present disclosure.

The present disclosure relates to a guiding tool 10 that can be used in conjunction with or to support a typical cutting tool 12, such as a jet cutter (shown in FIG. 1) or an abrasive perforator (shown in FIG. 2), to cut slots, instead of holes, in a formation and/or casing outside of the tool 10. The cutting tool 12 can be supported by the guiding tool 10 in numerous ways, such as the cutting tool 12 could be integrated to the guiding tool 10, connected to the guiding tool 10, or there could be one or more downhole tool disposed between the guiding tool 10 and the cutting tool 12. The slots cut by the cutting tool 12 and guiding tool 10 can be axial, tangential and/or at any angle desirable. The guiding tool 10 can also cause the slots to be cut in various desirable patterns. The cutting tools 12 and the guiding tools 10 can be included in a bottom hole assembly (BHA) with a number of other tools. The BHA can be disposed at the end of piping, such as coiled tubing, drill pipe, or any other type of tubing or piping used in the oil and gas industry.

Typically, a high velocity abrasive fluid is used with the cutting tools 12 described herein. To create the high velocity of the abrasive fluid, the abrasive fluid is forced through the piping and the cutting tools 12 at very high hydraulic pressures (for example, above 2000 psi). The guiding tool 10 of the present disclosure is actuated by the high hydraulic pressure flowing therethrough. The cutting tools 12 take a certain amount of time to be able to cut into the formation or through the casing. Thus, the guiding 10 tool is designed such that it is set up to take a corresponding amount of time to extend the length of the desired slot created. For example, it may take 30 minutes or more to cut a single slot and the guiding tool 10 is designed such that it rotates, moves or extends the cutting tool 12 the length of the desired slot for the 30 minutes or more.

Figure 3:
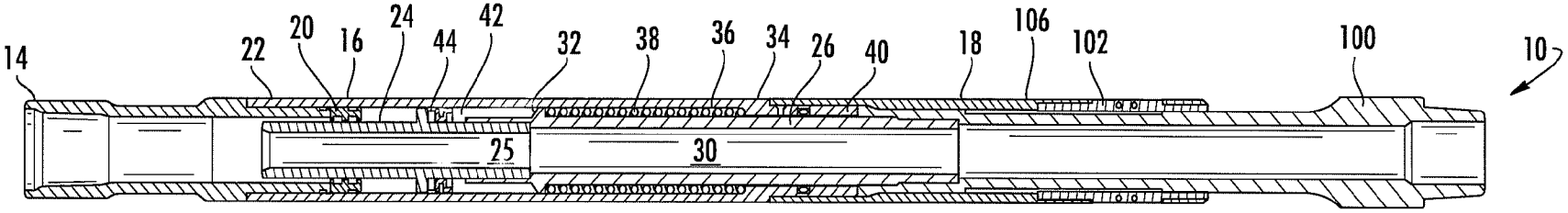
FIG. 3 is a cross-sectional view of one embodiment of the downhole tool constructed in accordance with the present disclosure.
Figure 4:
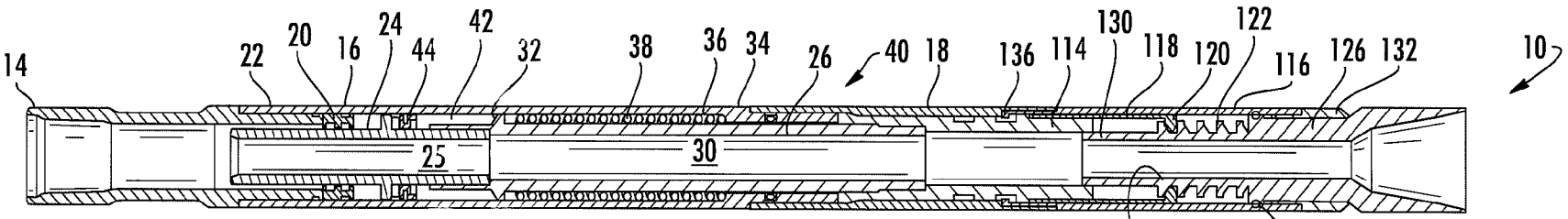
FIG. 4 is a cross-sectional view of another embodiment of the downhole tool constructed in accordance with the present disclosure.

Now referring to FIGS. 3 and 4, shown therein are various embodiments of a guiding tool 10. The guiding tool 10 includes a top sub 14 for receiving fluid and connecting to other downhole tools disposed uphole from the guiding tool 10, a timer housing 16 connected to the top sub 14 encapsulating various parts of the guiding tool 10, a lower connector 18 attached to the timer housing 16. It should be understood that the timer housing 16 and the lower connector 18 can be referred to as a housing. The guiding tool 10 also includes a balance piston 20 attached to a portion of the top sub 14 that extends into a first end 22 of the timer housing 16, an upper timer mandrel 24 slidably disposed within the timer housing 16 and includes a portion that is slidably disposed within the balance piston 20, a lower timer mandrel 26 connected to the upper timer mandrel 24 and having a portion slidably disposed within the timer housing 16. It should be understood and appreciated that the upper timer mandrel 24 and the lower timer mandrel 26 can be disposed in the guiding tool 10 as a single mandrel.

The upper timer mandrel 24 and the lower timer mandrel 26 includes fluid passageways 25 and 30, respectively, disposed therein to permit fluid to flow therethrough from the top sub 14. The lower timer mandrel 26 can include a lip 32 disposed thereon and a lower internal portion 34 of the timer housing 16 can include a shoulder 36. A compression spring 38 can be disposed between the lip 32 of the lower timer mandrel 26 and the shoulder 36 of the timer housing 16 and around a portion of the lower timer mandrel 26. The spring 38 is there to force the upper timer mandrel 24 and the lower timer mandrel 26 upward when hydraulic pressure drops below a specific level inside the guiding tool 10. The timer housing 16, the balance piston 20, and an area where the lower part of the timer housing 16 and the lower part of the lower timer mandrel 26 create a substantially fluidically sealed area 40, cooperate to create a hydraulic fluid chamber 42.

Figure 5:
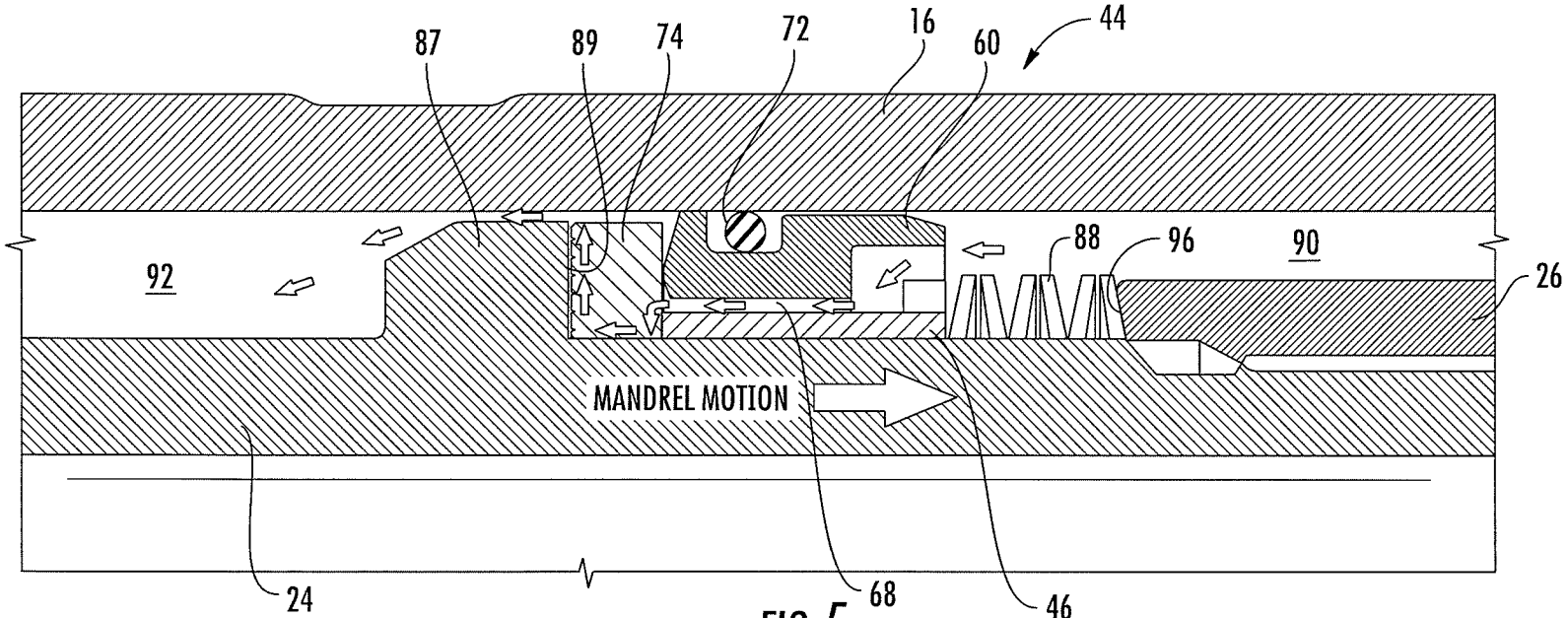
FIG. 5 is a cross-sectional view of a portion of the downhole tool constructed in accordance with the present disclosure.
Figure 6:
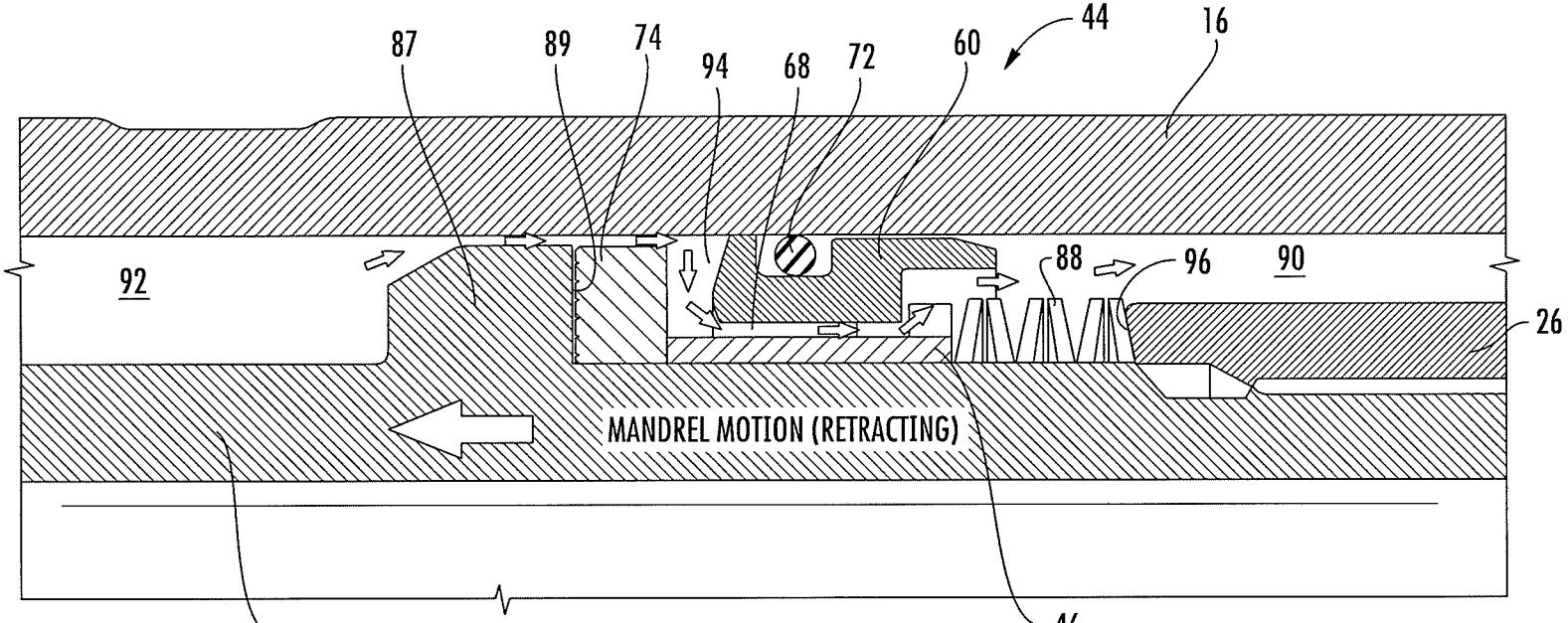
FIG. 6 is a cross-sectional view of the portion of the downhole tool shown in FIG. 5 in another position and constructed in accordance with the present disclosure.
Figure 7:
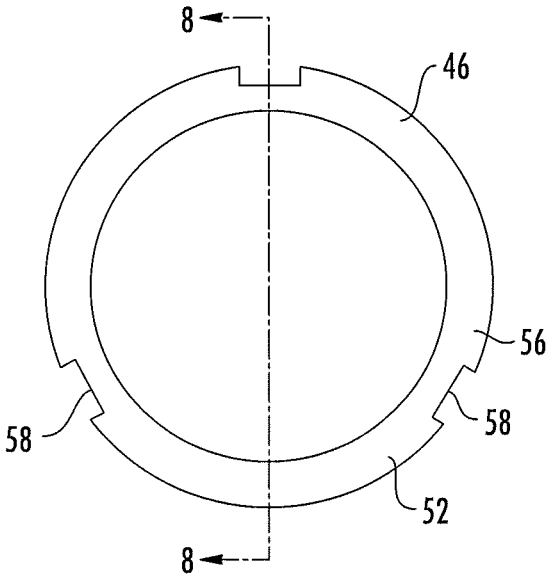
FIG. 7 is an end view of a piston sleeve constructed in accordance with the present disclosure.
Figure 8:
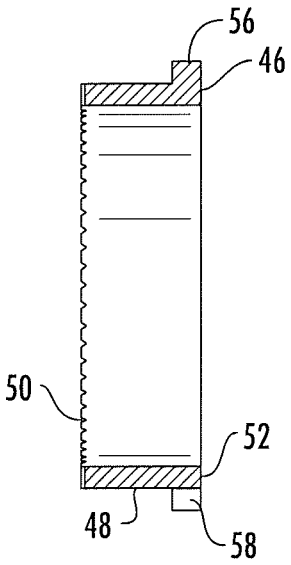
FIG. 8 is a sectional view taken along line 8-8 of FIG. 7 through the piston sleeve.
Figure 9:
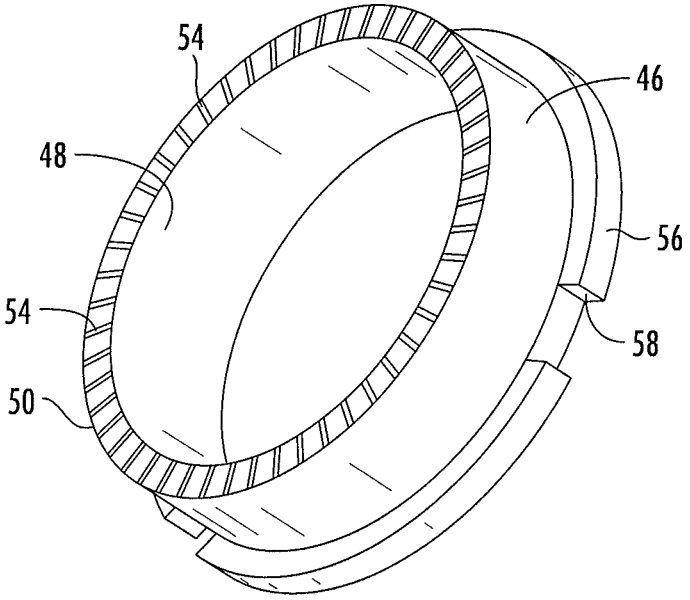
FIG. 9 is a perspective view of a base end of the piston sleeve.
Figure 10:
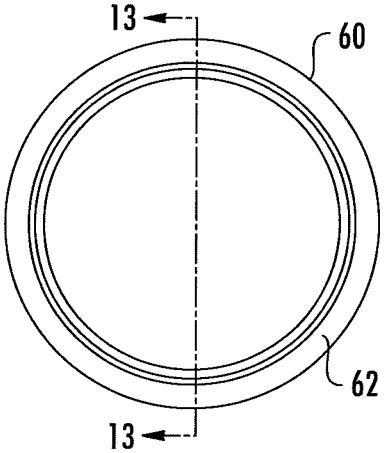
FIG. 10 is an elevational view of a base end of a second piston constructed in accordance with the present disclosure.
Figure 11:
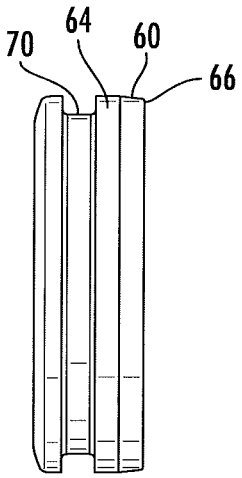
FIG. 11 is a side elevational view of the second piston.
Figure 12:
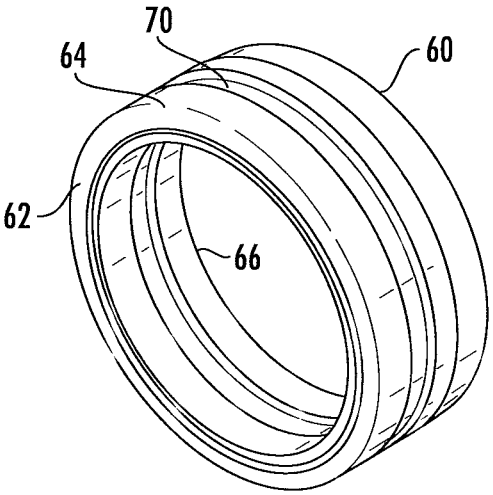
FIG. 12 is a perspective view of a base end of the second piston.
Figure 13:
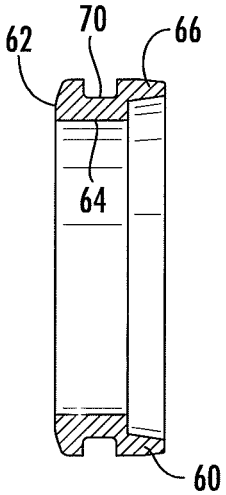
FIG. 13 is a sectional view taken along line 13-13 of FIG. 10.
Figure 14:
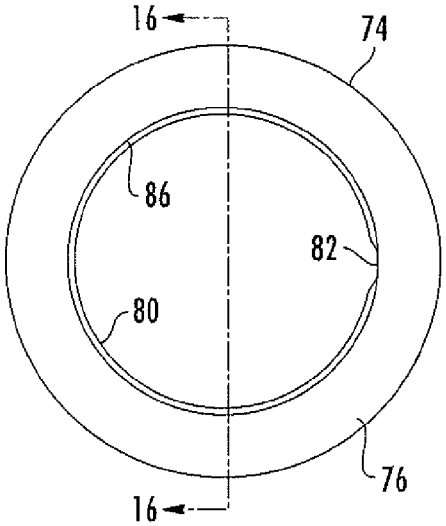
FIG. 14 is an elevational view of a piston face of a flow meter constructed in accordance with the present disclosure.
Figure 15:
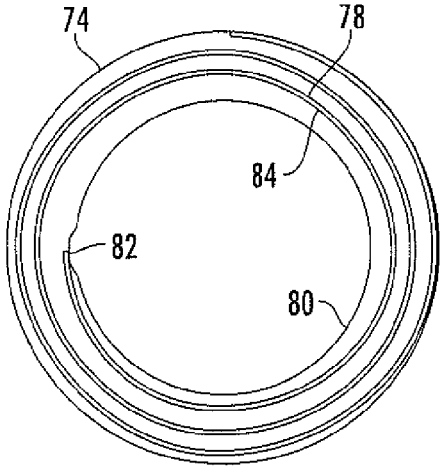
FIG. 15 is an elevational view of a metering face of the flow meter.
Figure 16:
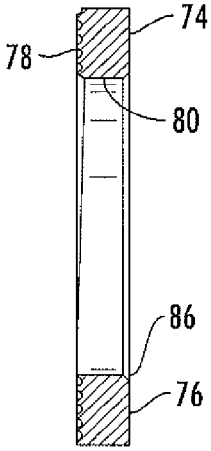
FIG. 16 is a sectional view taken along line 16-16 of FIG. 14.
Figure 17:
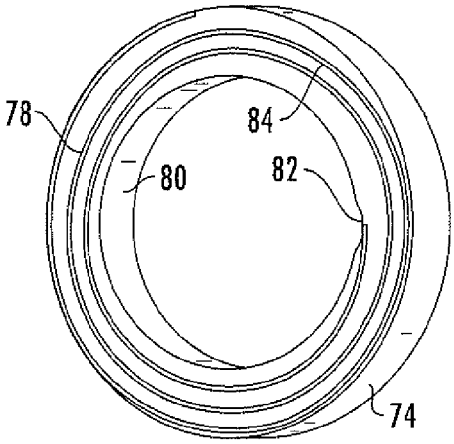
FIG. 17 is a perspective view of the metering face of the flow meter.

Shown in more detail in FIGS. 5 and 6, the guiding tool 10 can also include a piston assembly 44 disposed inside the timer housing 16, around a lower portion of the upper timer mandrel 24 and adjacent to the lip 32 disposed around the upper timer mandrel 24. The piston assembly 44 is provided to reduce the rate at which the upper and lower timer mandrels 24, 26 move downward in the guiding tool 10. The piston assembly 44 includes a piston sleeve 46 supported on the outer diameter of the upper mandrel 24. The piston sleeve 46, shown in more detail in FIGS. 7-9, comprises a sleeve body 48 with a first or base end 50 and a flanged second or cup end 52. The base end 50 is provided with radial grooves 54, and a flange 56 extends from the second end 52. The flange 56 has notches 58 cut therein.

A second piston 60 is slidably supported coaxially around the piston sleeve 46. The second piston 60, shown in detail in FIGS. 10-13, has a base end 62, which preferably is curved or otherwise profiled so as to be nonplanar for a reason which will become apparent. An extension element 64 extends from the base 62 and terminates in a lip 66. The inner diameter of the base 62 of the piston 60 is slightly larger than the outer diameter of the piston sleeve 46 to provide a flow channel 68 therebetween. The extension element 64 includes a groove 70 disposed therein that runs around the outer perimeter of the extension element 64 wherein a sealing element 72 can be disposed therein to prevent fluid from passing between the inside portion of the timer housing 16 and the outside of the second piston 60.

The piston assembly 44 further comprises a flow meter 74, shown in detail in FIGS. 14-17. The flow meter 74 has an annular piston face 76 on one end and a metering face 78 on the other end. The inner diameter 80 of the flow meter 74 has a lengthwise groove 82 that is in fluid communication with a spiral bleed channel 84 formed on the metering face 78. The edge 86 between the inner diameter 80 and the piston face 76 is beveled.

As best seen in FIGS. 5 and 6, the flow meter 74 is supported on the upper timer mandrel 24 so that the piston face 76 opposes and is adjacent to the base end 62 of the second piston 60 and the grooved base end 50 of the piston sleeve 46. The metering face 78 of the flow meter 74 abuts an annular face 89 of a collar 87 which is formed near the lower end of the upper timer mandrel 24.

One or more springs 88 are supported between the flanged cup end 52 of the piston sleeve 46 and uppermost end 96 of the lower timer mandrel 26. These springs are included to accommodate slight variances in tolerances resulting from manufacturing. Thus, the springs should be strong enough to resist any movement in the piston sleeve 46 during operation of the guiding tool 10.

In use, abrasive perforating fluid is flowed through the guiding tool 10 and to the cutting tool 12 below to perforate slots in the formation or casing. The hydraulic pressure of the perforating fluid during cutting operations forces the upper timer mandrel 24 and the lower timer mandrel 26 downward against the compression spring 38 in the guiding tool 10. The downward velocity of the mandrels 24, 26 is restricted by hydraulic fluid passing from a lower chamber 90 in the hydraulic fluid chamber 42, across the piston assembly 44 and the flow meter 74, and to an upper chamber 92 in the hydraulic fluid chamber 42. The path of the hydraulic fluid through this path indicated by the arrows shown in FIG. 5. The restriction in the flow path can be set to limit the travel of the mandrels 24, 26 to a rate of 1 to 6 inches per hour. It should be understood that the guiding tool 10 can be designed such that the length of travel of the mandrels 24, 26 and the time it takes to travel the full length can be any length and time desired.

More specifically, the fluid enters the flow channel 68 between the inner diameter of the second piston 60 and the outer diameter of the piston sleeve 46. The fluid then flows between the radial grooves 54 on the grooved end 50 of the piston sleeve 46, through the lengthwise groove 82 on the inner diameter 80 of the flow meter 74, and then enters the spiral bleed channel 84 on the metering face 78. When the fluid reaches the end of the spiral channel 84 it exits the piston assembly 44 between the outer diameter of the collar 87 and the inner portion of the timer housing 16 and flows up into the upper chamber 92 of the hydraulic fluid chamber 42.

When the hydraulic pressure of the perforating fluid is reduced below a certain amount, the piston assembly 44 provides an unrestricted flow path for passage of the hydraulic fluid to flow from the upper chamber 92 of the hydraulic fluid chamber 42 to the lower chamber 90 of the hydraulic fluid chamber 42. The upper and lower timer mandrels 24, 26 can then be quickly propelled back to a starting position by the compression spring 38. This unrestricted flow path is by arrows illustrated in FIG. 6. As the upper timer mandrel 24 is pushed upward (uphole direction) by the compression spring 38, the second piston 60 is urged toward the springs 88 creating a space 94 between the base end 62 of the second piston 60 and the piston face 76 of the flow meter 74. This allows the hydraulic fluid to pass from the upper chamber 92 of the hydraulic fluid chamber 42, between the collar 87 and the internal portion of the timer housing 16, into the space 94 between the second piston 60 and the flow meter 74 and through the flow channel 68 between the second piston 60 and piston sleeve 46 out into lower chamber 90 of the hydraulic fluid chamber 42.

While a preferred timing or metering mechanism has been shown and described herein, it will be appreciated that the present invention is not so limited. Other metering structures, such as annular flow channels, orifices, tortuous paths of different configuration, may be employed.

Figure 18:
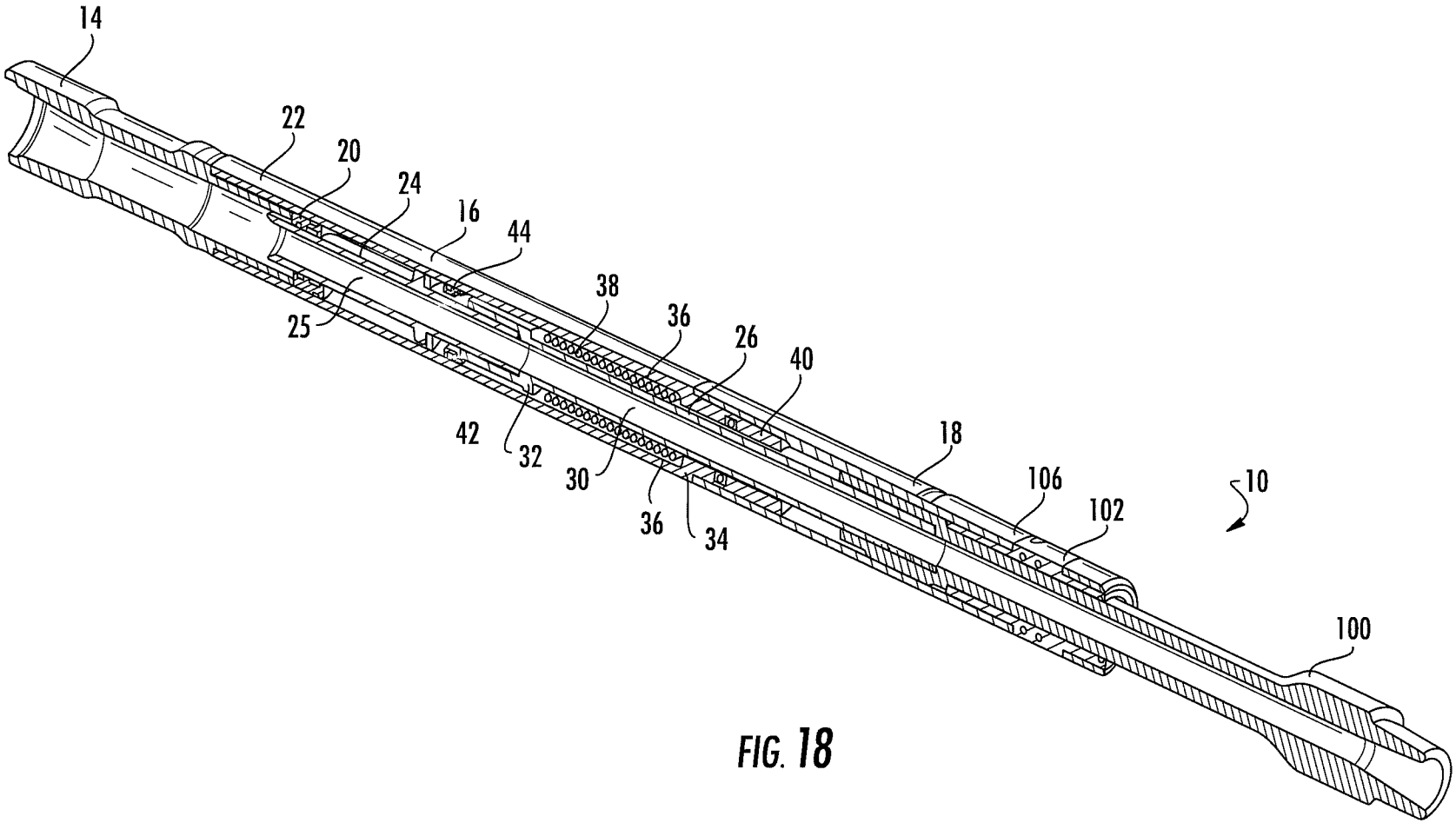
FIG. 18 is a perspective view of the embodiment of the downhole tool shown in FIG. 3 and constructed in accordance with the present disclosure.

In one embodiment shown in FIGS. 3 and 18, the guiding tool further includes a lower mandrel 100 slidably and rotatably disposed within a split collar 102 and attached to the lower timer mandrel 26. The split collar 102 is connected to the timer housing 16 via the lower connector 18. The lower mandrel 100 can be attached on its lower end 106 to the cutting tool 12. As high pressure fluid is forced into the guiding tool 10, the hydraulic fluid in the hydraulic fluid chamber 42 is forced from its lower chamber 90 to the upper chamber 92 via the piston assembly 44, which causes nozzles 108 disposed in the cutting tool 12 to slowly extend downward (in the downhole direction) causing a slot to be cut in the formation or casing, rather than a "hole."

Figure 19A:
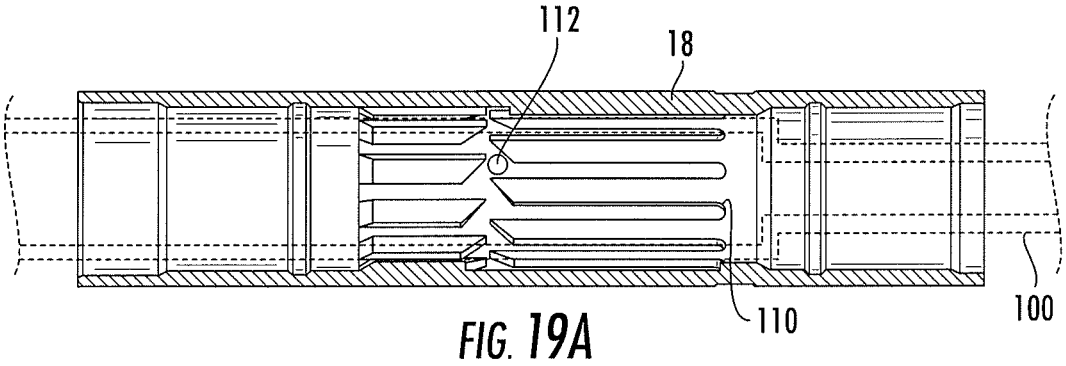
FIGS. 19A and 19B are see-through side elevation views of a portion of the downhole tool constructed in accordance with the present disclosure.
Figure 19B:
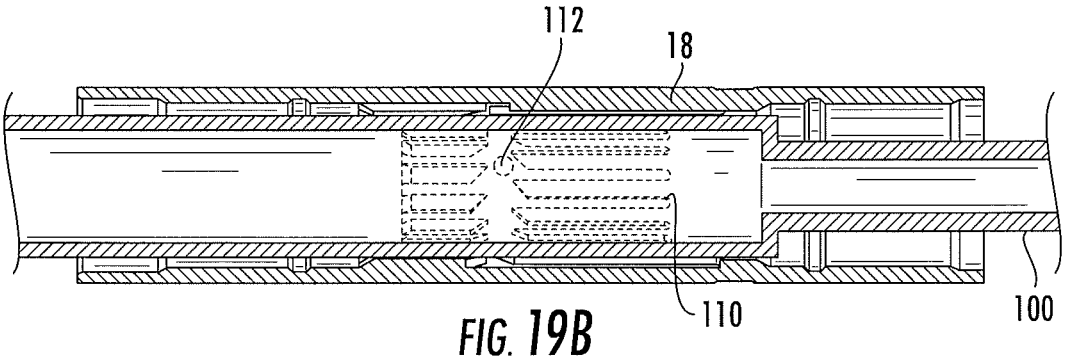
Figure 20:
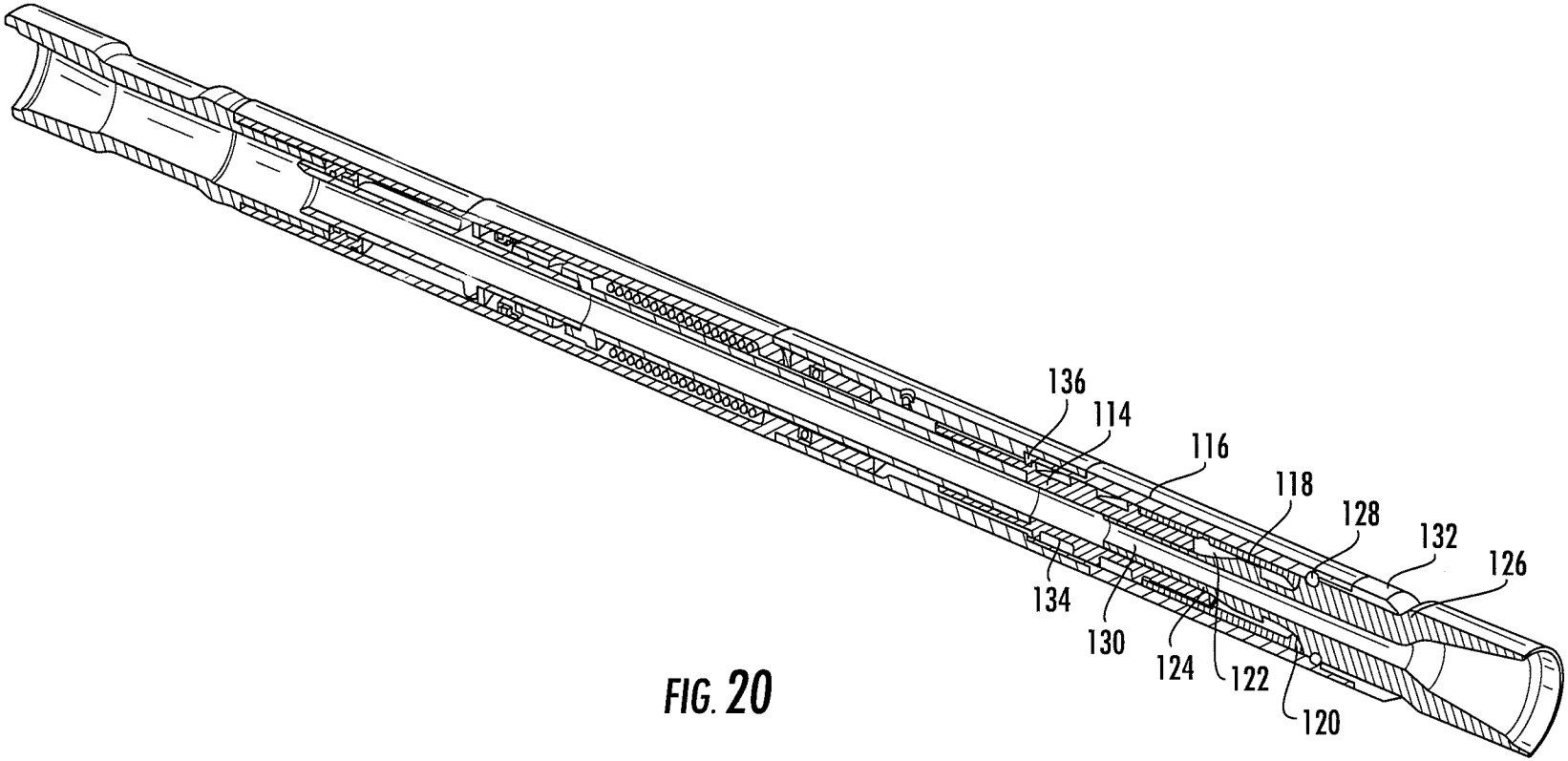
FIG. 20 is a perspective view of the embodiment of the downhole tool shown in FIG. 4 and constructed in accordance with the present disclosure.
Figure 21:
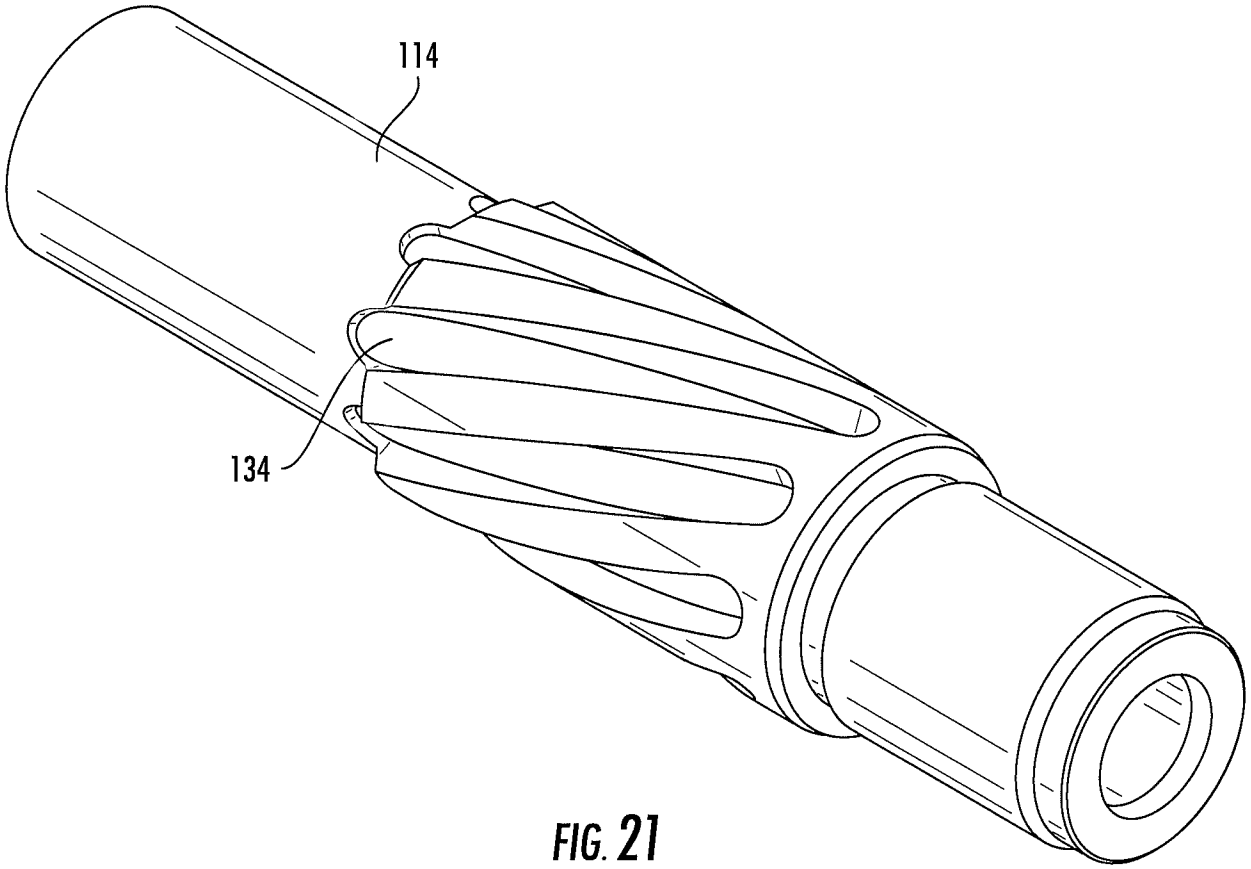
FIG. 21 is a perspective view of a portion of the embodiment of the downhole tool shown in FIGS. 4 and 20.
Figure 22C:
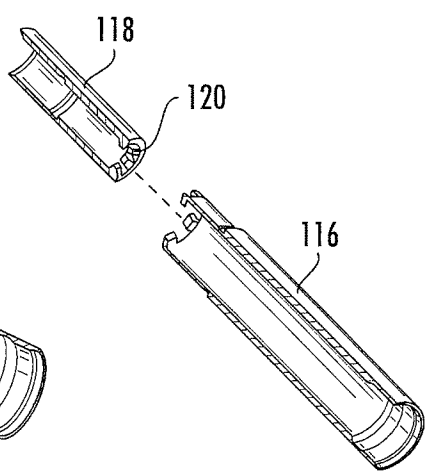
FIGS. 22A, 22B and 22C are exploded views of a portion of the embodiment of the downhole tool shown in FIGS. 4 and 20.
Figure 22B:
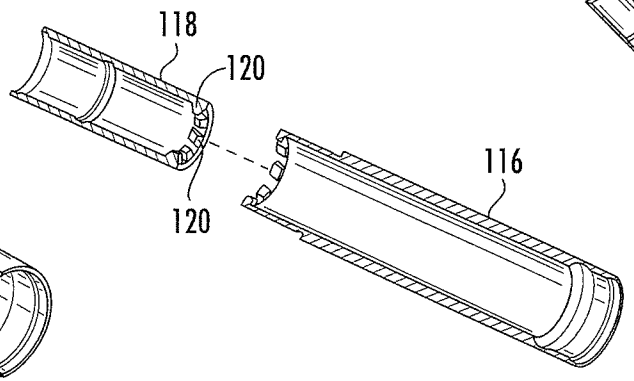
Figure 22A:
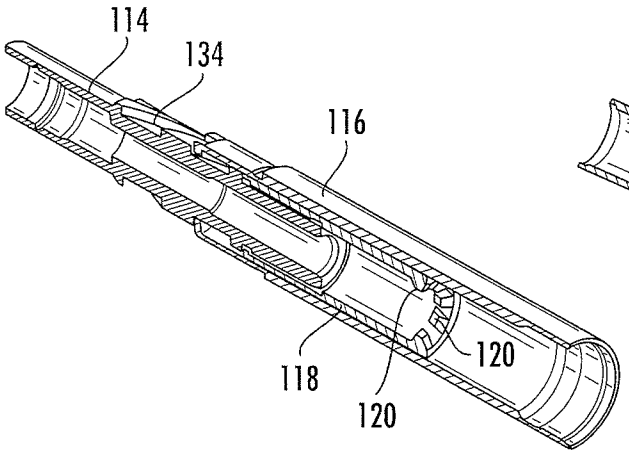
Figures 23A, 23B, 23C:
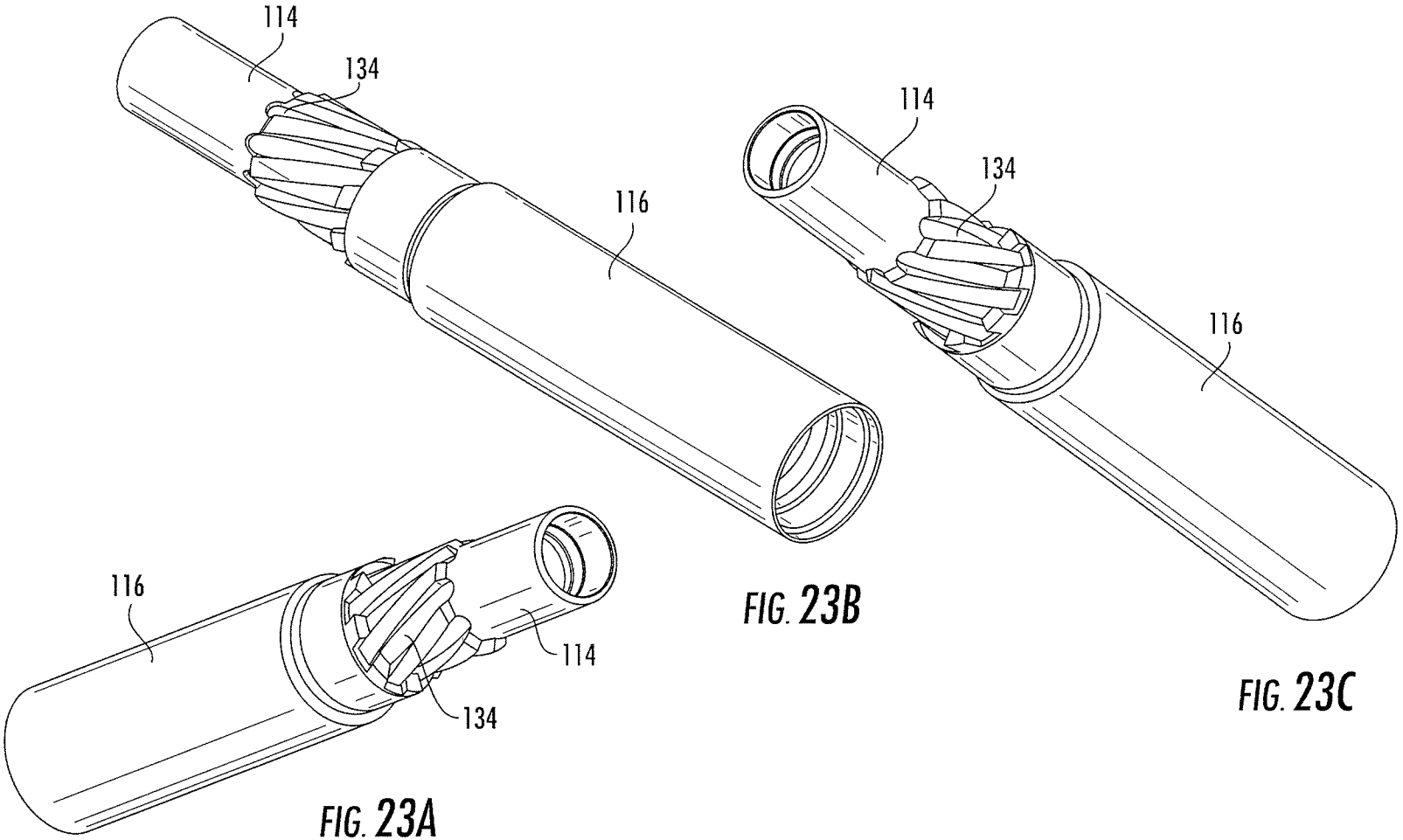
FIGS. 23A, 23B and 23C are perspective views of another portion of the embodiment of the downhole tool shown in FIGS. 4 and 20.
Figure 24:
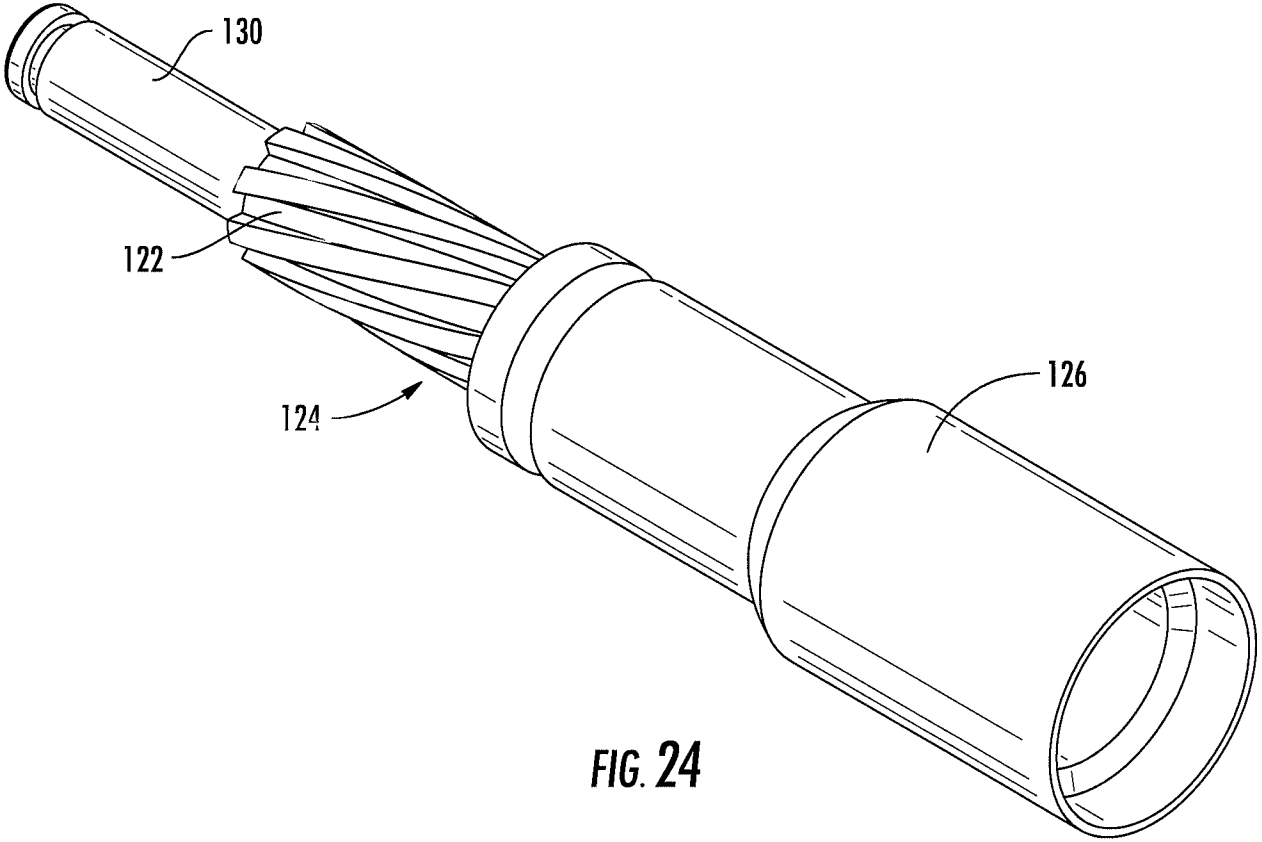
FIG. 24 is a perspective view of yet another portion of the embodiment of the downhole tool shown in FIGS. 4 and 20.

In another embodiment similar to that shown in FIG. 3, the guiding tool 10 provides for rotational movement to be transferred to the cutting tool 12 in addition to the downward movement. In this embodiment, the lower connector 18 (or housing of the guiding tool 10) can have a 3-slot pattern 110 cut on the inside (shown in FIG. 19A) and the lower mandrel 100 can have a pin 112 element disposed thereon to engage the J-slot pattern 110 to make the lower mandrel 100 follow the 3-slot pattern 110 in the lower connector 18. In another embodiment shown in FIG. 19B, the j-slot pattern 110 can be provided on the lower mandrel 100 and the pin 112 is disposed on the inside of the lower connector 18. The lower connector 18 and/or the lower mandrel 100 can have any type of pattern disposed therein to create whatever shaped slot desirable. The J-slot patterns 110 shown in FIGS. 19A and 19B are merely provided as examples. The lower mandrel 100 is forced downward at the same rate and for same length as the upper and lower timer mandrels 24, 26.

In another embodiment shown in FIGS. 4 and 20-24, the guiding tool 10 translates all of the downward movement of the upper timer mandrel 24 and the lower timer mandrel 26 to rotation of the cutting tools 12 without moving the cutting tool 12 downward while cutting. Thus, the nozzles 108 of the cutting tool 12 rotate to cut an arc in the casing. It should be understood that if the arc is long enough then the slot cut by the nozzles 108 of the cutting tool 12 would make a complete circle, which would cut off a portion of the casing. In this embodiment, the guiding tool further includes an upper cam 114 rotatably connected to the lower timer mandrel 26 and disposed within a second lower connector 116 which is attached to the lower connector 18. The guiding tool 10 also includes a follower element 118 with at least one pin element 120 disposed thereon to engage at least one helical shaped embossed area 122 disposed on a central portion 124 of a lower cam 126 that is rotatably disposed at least partially within the second lower connector 116.

A ball bearing 128 can be placed between the second lower connector 116 and the lower cam 126 to facilitate the rotation of the lower cam 126. An upper portion 130 of the lower cam 126 is slidably and rotatably disposed within a portion of the upper cam 114. The guiding tool 10 can also include a retaining element 132 disposed on the lower end of the second lower connector 116 to keep the lower cam 126 secured to the guiding tool 10.

In use, the lower timer mandrel 26 moves downward as disclosed herein and forces the upper cam 114 and the follower element 118 downward. As the follower element 118 is moved downward, the at least one pin 120 of the follower element 118 is forced downward in the embossed area 122 disposed on the central portion 124 of the lower cam 126 which forces the lower cam 126 to rotate as the upper cam 114 and follower element 118 move downward.

In another embodiment of the present disclosure, the upper cam 114 can have at least one helical shaped embossed area 134 disposed on the outside portion and the upper part of the second lower connector 116 can include at least one pin element 136 to engage with the at least one helical shaped embossed area 134 disposed on the upper cam 114 to force the rotation of the upper cam 114 as the upper and lower timer mandrels 24, 26 are moved downward in the guiding tool 10. The at least one pin on the second lower connector 116 and the helical shaped embossed area 134 on the upper cam 114 cooperate with the at least one pin 120 on the follower element 118 and the helical shaped embossed area 122 on the lower cam 126 to provide even further rotational movement to the lower cam 126, and thus the cutting tool 12 attached thereto.

In use, as the upper and lower timer mandrels 24, 26 are moved downward as previously disclosed herein, the upper cam 114 is forced downward wherein the at least one pin 136 on the second lower connector 116 to rotate the upper cam 114 as it is moved downward. The follower element 118 is forcibly rotated by its attachment to the upper cam 114, and thus, the at least one pin 120 disposed on the follower element 118. The rotation of the follower element 118 and the downward movement of the follower element 118 are translated to the helical embossed area 122 disposed on the central portion of the lower cam 126 which provides even more rotation to the lower cam 126 than in previous embodiments. It should be understood that a helical embossed pattern is described herein but the embossed profile on the upper and lower cams 114, 126 can be any pattern desired such that the lower cam 126 is forced to rotate at a desired rate and/or arc distance. It should be understood and appreciated that while the embossed areas 122, 134 on the upper and lower cams 114, 126 is described herein as helical, the embossed areas 122, 134 can be any shape and size. For example, it may be desirable to make the embossed area a straight line.

In use, when the abrasive perforating fluid flowing through the guiding tool 10 to the cutting tool 12 is pressured up to be able to abrasively perforate, the lower mandrel 100 will travel to its extreme lower position positioning the nozzles 108 of the cutting tool 12 in a fixed position as long as the pressure of the fluid flowing through the guiding tool 10 and the cutting tool 12 remains above a specific pressure. While the lower mandrel 100 is in the extended position, perforations which correspond to the nozzles 108 in the cutting tool 12 will be formed in the casing and/or formation. After the pressure of the fluid is relieved, the compression spring 38 will return the lower mandrel 100 and cutting tool 12 to the retracted position.

Depending on the design of the j-slot pattern 110, some rotation of the lower mandrel 100 may occur during either the pressure-up cycle, or the pressure-down cycle, or during both the pressure-up and pressure-down cycles. With each subsequent application and release of the perforating pressure the perforating nozzles 108 in the cutting tool 12 will rotate into a new position which again, depending on the design of the j-slot pattern 110 can be at the same, or at a different axial position in the well as the previous nozzle position. If the j-slot pattern 110 is designed such that the nozzles 108 of the cutting tool 12 always stop at the same axial position within the wellbore and are rotated such that the resulting perforations form a closely spaced tangential pattern of perforated holes, the casing or other tubular may be cut completely. In this way a downhole tubular may be completely severed or substantially weakened using a series of judiciously placed, closely spaced perforations.

A different j-slot design could also be used in conjunction with a properly configured cutting tool 12 to form almost any pattern of perforated holes downhole. For instance, a cutting tool 12 which has a nozzle arrangement consisting of 3 nozzles in a single plane could be used with j-slot which first creates 3 perforations in a first plane and then rotates the cutting tool 12 60 degrees and translates the cutting tool 12 some prescribed axial distance from the first position so the next perforating cycle creates 3 more perforations in a second plane which is the prescribed axial distance from the first plane and rotated 60 degrees.

In another embodiment, a 3 hole cutting tool 12 with the nozzles 108 arranged in a classic 60 degree spiral pattern could be used. In this case, the first 3 perforations would be created during the first pressure cycle, but during the second pressure cycle, the cutting tool 12 would be rotated 180 degrees from the first position and moved the proper distance such that when the next 3 perforations are formed, they will complete the desired classic 6-hole, 60 degree spiral pattern of perforations. This same method could be used with 1 or 2 nozzles rotating 60 degrees or 120 degrees, respectively, with 6 pressure cycles or 3 pressure cycles respectively. Almost any pattern using almost any number of nozzles can be created in this way using a properly design j-slot.

From the above description, it is clear that the present disclosure is well adapted to carry out the objectives and to attain the advantages mentioned herein as well as those inherent in the disclosure. While presently disclosed embodiments have been described for purposes of this disclosure, it will be understood that numerous changes may be made which will readily suggest themselves to those skilled in the art and which are accomplished within the spirit of the disclosure.

What is claimed is:

1. An apparatus, the apparatus comprising:

a guiding tool for transferring fluid pressure to movement of a cutting tool relative to the guiding tool while the cutting tool is cutting slots in a casing or formation via at least one nozzle disposed in the cutting tool, the guiding tool comprising:

a timer mandrel slidably disposed within a housing;

a lower mandrel at least partially slidably disposed in the housing, the lower mandrel supported by the timer mandrel on one end and attachable to another downhole tool on another end; and a restricted flow path that restricts flow of hydraulic fluid from a lower chamber of the hydraulic fluid chamber to an upper chamber of the hydraulic fluid chamber to reduce the rate at which the lower mandrel extends from the housing when fluid is pressured up in the guiding tool.

2. The apparatus of claim 1 wherein the movement of the cutting tool is axially relative to the guiding tool, rotationally relative to the guiding tool, or a combination thereof.

3. The apparatus of claim 1 wherein the restricted flow path is disposed in a piston assembly disposed around a portion of the timer mandrel and within a hydraulic fluid chamber.

4. The apparatus of claim 3 wherein the piston assembly comprises:

a piston sleeve disposed around a portion of the timer mandrel;

a second piston slidably disposed between the piston sleeve and the housing wherein a flow path is created between the piston sleeve and the second piston;

a flow meter disposed around a portion of the timer mandrel and between the second piston and a collar disposed on the timer mandrel, the flow meter having a bleed channel for restricting flow of fluid therethrough disposed on a side of the flow meter that is adjacent to the collar and a groove disposed on an inner portion to allow fluid to flow from the flow path between the piston sleeve and the second piston, between the flow meter and an outer portion of the timer mandrel and into the bleed channel on the flow meter.

5. The apparatus of claim 4 wherein the timer mandrel is comprised of an upper timer mandrel and a lower timer mandrel wherein the piston assembly is disposed on the upper timer mandrel.

6. The apparatus of claim 5 wherein the lower timer mandrel includes a compression spring disposed therearound to force the upper and lower timer mandrels in an uphole direction when pressure of the fluid is reduced below a predetermined pressure in the guiding tool, the compression spring disposed between a collar disposed on the lower timer mandrel and a shoulder disposed on an inside portion of the housing.

7. The apparatus of claim 5 wherein the upper timer mandrel, the lower timer mandrel, and the lower mandrel have fluid passageways disposed therein.

8. The apparatus of claim 1 wherein the lower mandrel has a slot pattern disposed thereon to engage with a pin disposed on an inside portion of the housing to cause nozzles of the cutting tool to cut the slot pattern in a casing or formation.

9. The apparatus of claim 1 wherein the lower mandrel has a pin disposed thereon to engage with a slot pattern disposed on an inside portion of the housing to cause nozzles of the cutting tool to cut the slot pattern in a casing or formation.

10. An apparatus, the apparatus comprising:

a guiding tool for transferring fluid pressure to movement of a cutting tool relative to the guiding tool while the cutting tool is cutting slots in a casing or formation via at least one nozzle disposed in the cutting tool, the guiding tool comprising:

a timer mandrel slidably and rotatably disposed within a housing;

a bottom sub having a first cam attached thereto and rotatably supported by the housing, the first cam having an embossed helical pattern disposed thereon;

a guiding element supported by the timer mandrel and having a guiding pin to engage the embossed helical pattern to transfer downward movement of the timer mandrel into rotational movement of the bottom sub as the guiding element is forced downward by the timer mandrel and forces the first cam and bottom sub to rotate as the guiding pin engages the embossed helical pattern; and a restricted flow path that restricts flow of hydraulic fluid from a lower chamber of the hydraulic fluid chamber to an upper chamber of the hydraulic fluid chamber to reduce the rate at which the timer mandrel is shifted when fluid is pressured up in the guiding tool.

11. The apparatus of claim 10 wherein the restricted flow path is disposed in a piston assembly disposed around a portion of the timer mandrel and within a hydraulic fluid chamber.

12. The apparatus of claim 10 wherein the piston assembly comprises:

a piston sleeve disposed around a portion of the timer mandrel;

a second piston slidably disposed between the piston sleeve and the housing wherein a flow path is created between the piston sleeve and the second piston;

a flow meter disposed around a portion of the timer mandrel and between the second piston and a collar disposed on the timer mandrel, the flow meter having a bleed channel for restricting flow of fluid therethrough disposed on a side of the flow meter that is adjacent to the collar and a groove disposed on an inner portion to allow fluid to flow from the flow path between the piston sleeve and the second piston, between the flow meter and an outer portion of the timer mandrel and into the bleed channel on the flow meter.

13. The apparatus of claim 12 wherein the timer mandrel is comprised of an upper timer mandrel and a lower timer mandrel wherein the piston assembly is disposed on the upper timer mandrel.

14. The apparatus of claim 13 wherein the lower timer mandrel includes a compression spring disposed therearound to force the upper and lower timer mandrels in an uphole direction when pressure of the fluid is reduced below a predetermined pressure in the guiding tool, the compression spring disposed between a collar disposed on the lower timer mandrel and a shoulder disposed on an inside portion of the housing.

15. The apparatus of claim 13 wherein the upper timer mandrel, the lower timer mandrel, the bottom sub and the first cam have fluid passageways disposed therein.

16. An apparatus, the apparatus comprising:

a guiding tool for transferring fluid pressure to movement of a cutting tool relative to the guiding tool while the cutting tool is cutting slots in a casing or formation via at least one nozzle disposed in the cutting tool, the guiding tool comprising:

a timer mandrel slidably and rotatably disposed within a housing;

a bottom sub rotatably supported by the housing, the bottom sub having a first cam attached thereto and a tubular member extending therefrom, the first cam having an embossed helical pattern disposed thereon;

a second cam rotatably supported on a lower end of the timer mandrel, the second cam having an embossed helical pattern disposed thereon and a passageway disposed therethrough for slidably receiving the tubular member extending from the bottom sub;

a guiding pin disposed on an inside portion of the housing to engage the embossed helical pattern disposed on the second cam to force the second cam to rotate as the timer mandrel slides in the downhole direction in the guiding tool;

a guiding element supported by the second cam and having a guiding pin to engage the embossed helical pattern on the first cam to transfer downward movement of the timer mandrel and the second cam and rotational movement of the second cam into increased rotational movement of the bottom sub as the second cam is forced downward and slidably receives the tubular member extending from the bottom sub; and a restricted flow path that restricts flow of hydraulic fluid from a lower chamber of the hydraulic fluid chamber to an upper chamber of the hydraulic fluid chamber to reduce the rate at which the timer mandrel is shifted when fluid is pressured up in the guiding tool.

17. The apparatus of claim 16 wherein the timer mandrel, the first cam, the second cam, the bottom sub and the tubular member extending from the first cam have fluid passageways disposed therein.

* * * * *